11/10/87 XR SR 4,705,113

United States Patent [19]

Perkins

[11] Patent Number: 4,705,113

[45] Date of Patent: Nov. 10, 1987

[54] METHOD OF COLD WATER ENHANCED HYDRAULIC FRACTURING

[75] Inventor: Thomas K. Perkins, Dallas, Tex.

[73] Assignee: Atlantic Richfield Company, Los Angeles, Calif.

[21] Appl. No.: 425,343

[22] Filed: Sep. 28, 1982

[51] Int. Cl.[4] ..... E21B 36/00; E21B 43/26

[52] U.S. Cl. ..... 166/302; 166/308

[58] Field of Search ..... 166/302, 308

[56] References Cited

U.S. PATENT DOCUMENTS

| | | | |
|---|---|---|---|
| 3,195,634 | 7/1965 | Hill | 166/302 |
| 3,989,108 | 11/1976 | Allen | 166/302 |
| 4,068,720 | 1/1978 | Hessert et al. | 166/307 |
| 4,321,968 | 3/1982 | Clear | 166/308 |

OTHER PUBLICATIONS

"Production Operations", Allen, Thomas O.; Roberts, Alan P., 1978; Oil and Gas Consultants International, pp. 142–147.

*Primary Examiner*—George A. Suchfield
*Attorney, Agent, or Firm*—Albert C. Metrailer

[57] ABSTRACT

A method of initiating fractures in preselected zones by precooling the zones of interest. A cooling fluid is either circulated in a wellbore at the selected zone or injected into the selected zone. After cooling, conventional fracturing techniques are used, but fractures are more easily controlled by reduction of required pressures in the cooled zones.

2 Claims, 2 Drawing Figures

METHOD OF COLD WATER ENHANCED HYDRAULIC FRACTURING

BACKGROUND OF THE INVENTION

This invention relates to the fracturing of subterranean formations surrounding wellbores and more particularly, to the enhancement of fracturing by cooling of the formations.

The production rates of oil and gas wells are directly affected by the permeability of the producing formations adjacent the borehole. Various well known stimulation techniques are designed to increase the permeability of the formation at least near the borehole. Hydraulic fracturing has proved to be one of the most effective stimulation techniques since the fractures can be propagated great distances out into the formation.

The basic hydraulic fracturing technique involves the injection of a fluid into a formation at a pressure sufficiently above the ambient earth stresses to cause parting of the formation. Once a fracture has begun, it may typically be propagated at a pressure somewhat below the initial fracturing pressure. However, fractures are generally not controllable in terms of orientation or direction of travel. In deep wells, fractures tend to be vertical rather than horizontal but the exact orientation depends more on formation characteristics than on fracturing techniques. Since oil bearing zones tend to be thin layers, vertical fractures have a tendency to propagate above and/or below the oil bearing zone. Ideally, the fracture would be contained within the oil zone and extend laterally from the borehole as far as possible.

In some situations, formations other than the oil bearing zone of interest may be exposed to fracturing pressure. If the other zones have an initial fracturing pressure at or below that of the oil bearing zone, they will fracture first or at least in addition to the oil zone. Where such other zones cannot be physically isolated from the fracturing pressure, it is desirable to provide some other means of limiting the fractures to the desired zone.

SUMMARY OF THE INVENTION

Accordingly, an object of the present invention is to provide an improved method for fracturing subterranean formations.

Another object of the present invention is to provide a method for controllably reducing fracture pressure in selected subterranean formations.

Yet another object of the present invention is to provide a method for controlling the location and vertical extent of hydraulically generated fractures to preselected zones.

In accordance with the present invention, a preselected zone is cooled by means of a cooling fluid pumped down a wellbore so that initial fracturing pressure of the preselected zone is reduced allowing confinement of the fracture to the cooled region. In one form, cooling fluid is circulated within the borehole in the zone of interest while in a second preferred form, the cooling fluid is injected into the zone of interest.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENTS

Figure 1:
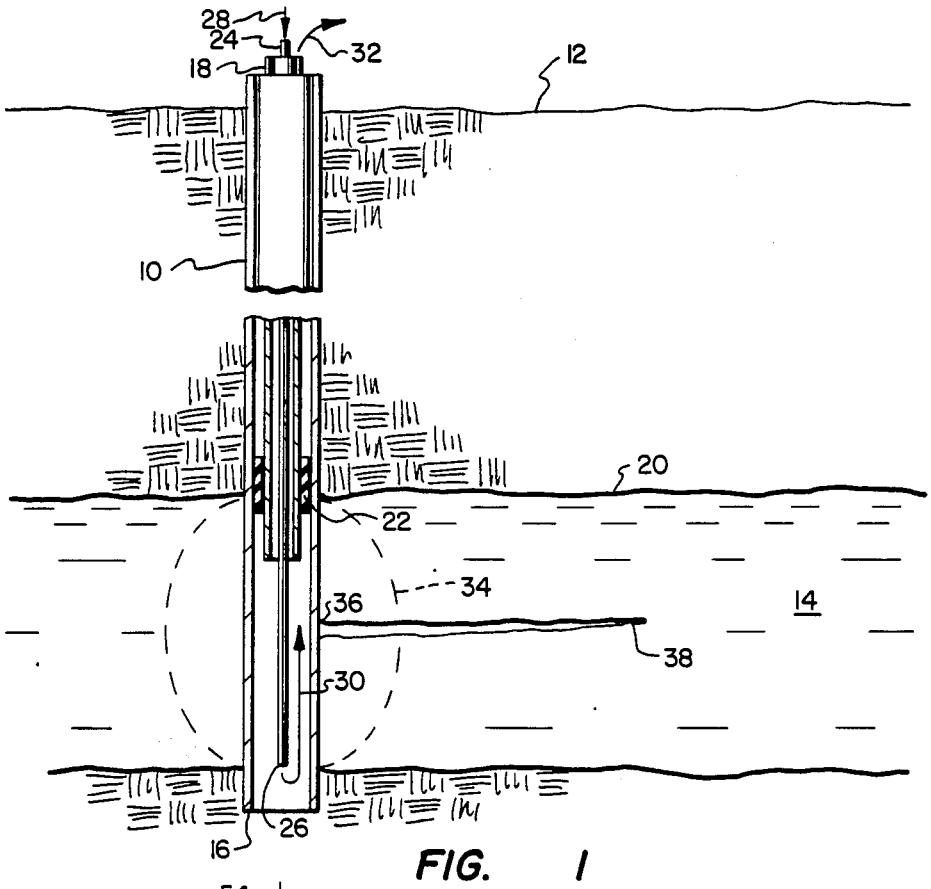
FIG. 1 is a cross-sectional illustration of a borehole equipped for circulation of a cooling fluid within a preselected subterranean zone.

With reference to FIG. 1, there is illustrated a borehole 10 extending from the surface of the earth 12 to a subterranean zone 14. Zone 14 may contain, for example, oil or natural gas. Borehole 10 is illustrated with casing extending from the surface 12 to its lower end 16 at approximately the bottom of formation 14. However, the present invention may also be practiced in open boreholes. Within borehole 10 is a first tubing 18 extending from surface 12 to approximately the upper edge 20 of formation 14. A packer 22 is preferably set between tubing 18 and the wall of borehole 10. A smaller tubing 24 is placed within tubing 18 and extends from surface 12 to the lower edge of formation 14.

I have found that the pressure required to initiate or propagate a fracture in a selected formation may be substantially reduced by precooling of the formation. Cooling reduces fracturing pressure by reducing internal stresses in the formation. The naturally occuring internal stresses in earth formations may typically be reduced by twenty pounds per square inch per degree Farenheit temperature reduction. Therefore, for a small temperature reduction of, for example, 5° to 10° F. the internal stresses and, therefore, the fracturing pressure may be reduced by 100 to 200 pounds per square inch in the chilled areas. The actual stress reduction in any given case may be substantially more or less than these typical values due to wide variations in formation properties.

Using the apparatus of FIG. 1, a cooling fluid may be injected down tubing 24 as indicated by the arrow 28. Upon exiting the lower end 26 of tubing 24, the fluid may flow back up the annulus between tubings 18 and 24 as indicated by arrows 30 and 32. As a result of such circulation, those portions of formation 14 immediately adjacent borehole 10 will be chilled, as indicated by dotted lines 34. The use of the double tubing arrangement 18 and 24 reduces cooling of formations above interface 20. Thus, the cooling effect is limited to zone 14.

Fracturing of zone 14 may proceed by injection of fracturing fluid down wellbore 10 with or without use of tubings 18 and 24. While the retention of tubing 18 and packer 22 would help in isolating the high pressure fracturing fluid to zone 14, the cooling of zone 34 within formation 14 has a similar effect. That is, even if the entire borehole 10 is exposed to the fracturing pressure, the cooled region 34 has a reduced fracturing pressure level so that fracturing will initiate within formation 14. Once a fracture has initiated near the wellbore at, for example, point 36, it will tend to propagate away from the borehole at the lower propagation pressure to some point 38 within formation 14. It will be appreciated that fracture propagation pressure will increase when the fracture extends beyond the cooled zone 34.

Figure 2:
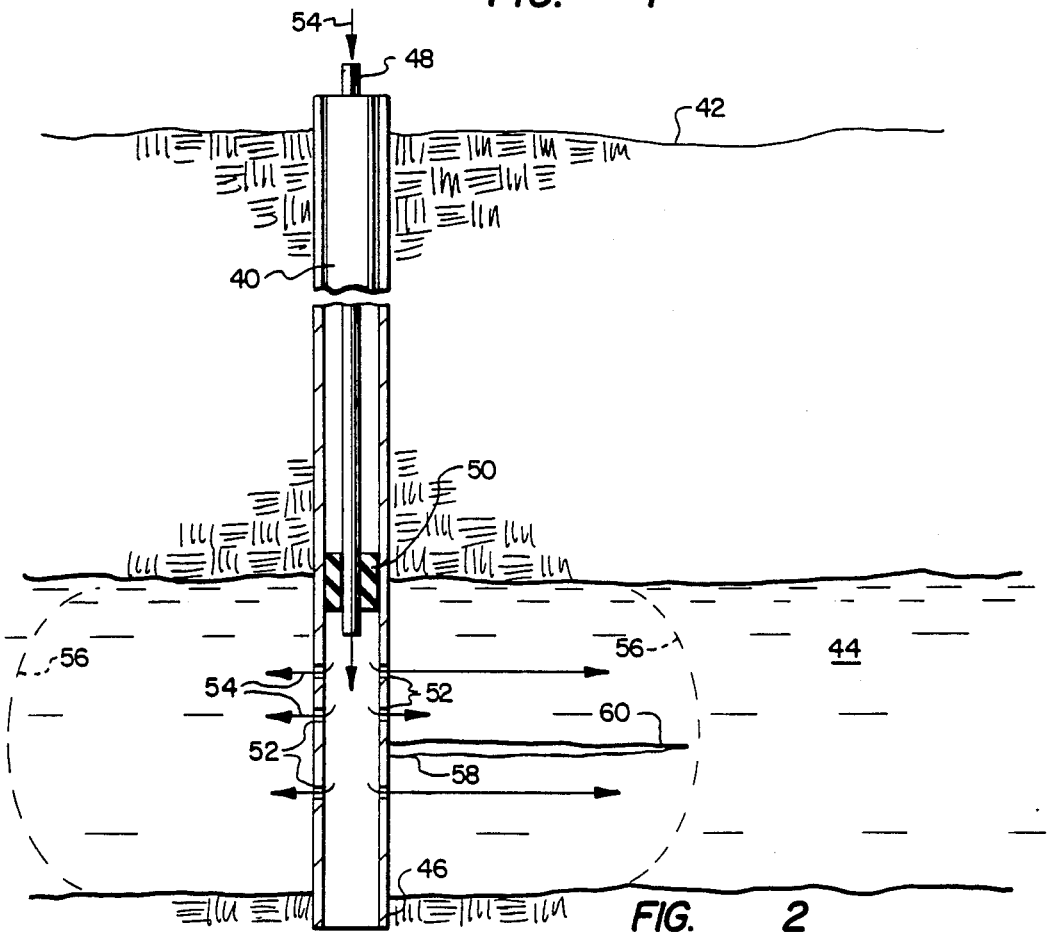
FIG. 2 is a cross-sectional illustration of a borehole equipped for cooling a subterranean formation according to a second embodiment of the present invention.

With reference now to FIG. 2, there is illustrated another borehole 40 extending from the earth's surface 42 to a producing zone 44. Borehole 40 is preferably cased to its lower end 46 at the bottom of formation 44. In this embodiment, a tubing 48 extends from surface 42 to a packer 50 set at the upper edge of formation 44. The borehole is perforated at 52 to allow cooling fluid pumped down tubing 48 to be injected into formation 44. In this embodiment, therefore, cooling of formation 44 occurs primarily by the flow of cold fluid into the formation itself. Cooling will occur more quickly than in the FIG. 1 embodiment in which conduction to the walls of the wellbore provides cooling to the formation. Due to the difference in rates of the two cooling methods, it may not be necessary to employ tubing 48 in the FIG. 2 embodiment. That is, while cold fluid flowing down borehole 40 would cool formations above reservoir 44, such cooling would be quite small with respect to that caused within the formation 44 by the injected cooling fluid.

As indicated by the arrow 54 in FIG. 2, the cooling fluid is injected down tubing 48 through perforations 52 to flow out into formation 44. Flow of the cooling fluid above and below formation 44 is generally limited by the same natural conditions which cause oil or gas to be trapped within zone 44. As a result, a cooled zone indicated by the dotted line 56 may extend laterally out from borehole 40 a considerable distance into formation 44 while being confined vertically almost entirely within the producing zone.

After the cooling fluid has been injected for a suitable period of time, a fracturing fluid, preferably also chilled, may be injected down borehole 40 at a pressure selected to initiate a fracture 58 in formation 44. As in the FIG. 1 embodiment, the fracture 58 can be expected to extend outward from borehole 40 to some point 60 determined by a number of factors such as the total quantity of fracturing fluid and the rate of injection. As indicated above, fractures in deep wells tend to be vertically oriented rather than horizontally oriented as indicated in FIGS. 1 and 2. As can be seen from FIG. 2, such vertical fractures will tend to be limited in vertical extent to the upper and lower boundries of the formation 44 of interest. Formations lying above and below zone 44 remain substantially at original ambient temperatures and thus exhibit higher fracturing pressures. The fracturing fluid may, therefore, be injected at a pressure below that which would initiate or propagate a fracture above or below producing zone 44 and the fracture 58 may still be propagated through the producing zone.

As indicated above, the conductive cooling arrangement of FIG. 1 would provide a slower cooling rate than the mass transfer cooling method of FIG. 2. It is anticipated that the FIG. 1 method would be used primarily to cause initiation of fractures at selected points and circulation on the order of several weeks to several months would be required. Cooling rate and required circulation time are, of course, dependent upon initial temperatures of the cooling water and the formation. While the FIG. 2 arrangement would provide more efficient cooling of the formation, it is still anticipated that minimum cooling periods would be on the order of several weeks time. Fracturing is generally required only in formations of low permeability which, therefore, means that the injected fluid cannot be pumped into the formation quickly without exceeding the fracture pressure. In addition, it will typically be desirable to pump the cooling fluids a considerable distance out into formation 44 in FIG. 2 to take the maximum advantage of the fracture guiding which may be achieved in this process.

While the present invention has been illustrated and described with respect to particular apparatus and methods of use, it is apparent that various modifications and changes can be made within the scope of the present invention as defined by the appended claims.

What is claimed is:

1. A method for fracturing a subterranean formation surrounding a borehole extending from the earth's surface to said formation comprising:

pumping a cooling fluid, having a temperature below the natural temperature of said formation, down a tubing in said borehole, circulating said fluid within said borehole adjacent said formation and returning said fluid to the surface without injecting said fluid into said formation for a time sufficient to cool said formation at least in those portions adjacent said borehole, and thereafter pumping a fracturing fluid down said borehole and into said formation at a pressure sufficient to fracture said formation adjacent said borehole.

2. A method of lowering the fracturing pressure of a preselected earth formation penetrated by a borehole comprising:

before initiation of a fracture in the preselected formation, pumping a cooling fluid down a tubing in the borehole, circulating said fluid within said borehole adjacent said formation and returning said fluid to the surface without injecting said fluid into said formation for a time sufficient to cool said formation at least in those portions in which a fracture is to be initiated.

* * * * *